US011780544B2

(12) United States Patent
Inoue

(10) Patent No.: US 11,780,544 B2
(45) Date of Patent: Oct. 10, 2023

(54) RIGGING EQUIPMENT DIAGNOSTIC DEVICE

(71) Applicant: YAMAHA HATSUDOKI KABUSHIKI KAISHA, Iwata (JP)

(72) Inventor: Ryota Inoue, Shizuoka (JP)

(73) Assignee: YAMAHA HATSUDOKI KABUSHIKI KAISHA, Shizuoka (JP)

( * ) Notice: Subject to any disclaimer, the term of this patent is extended or adjusted under 35 U.S.C. 154(b) by 230 days.

(21) Appl. No.: 16/856,574

(22) Filed: Apr. 23, 2020

(65) Prior Publication Data

US 2020/0339235 A1 Oct. 29, 2020

(30) Foreign Application Priority Data

Apr. 26, 2019 (JP) ..... 2019-086293

(51) Int. Cl.
*B63B 69/00* (2013.01)
*B63B 79/30* (2020.01)

(52) U.S. Cl.
CPC ..... *B63B 79/30* (2020.01)

(58) Field of Classification Search
CPC ..... B63B 79/30
See application file for complete search history.

(56) References Cited

U.S. PATENT DOCUMENTS 5,717,595 A * 2/1998 Cherrington ..... G01M 15/05 702/170
2003/0060946 A1* 3/2003 Okuyama ..... F02B 77/08 701/31.4
2010/0305789 A1* 12/2010 Ito ..... B63H 21/213 700/21
2014/0109075 A1* 4/2014 Hoffman ..... G06F 11/1464 717/169
2015/0057854 A1* 2/2015 Remmers ..... G06Q 30/0621 701/21
2016/0078403 A1* 3/2016 Sethi ..... G06Q 10/0875 705/26.81

FOREIGN PATENT DOCUMENTS

KR 10-2016-0115063 A 10/2016

* cited by examiner

*Primary Examiner* — Stephen Holwerda
(74) *Attorney, Agent, or Firm* — KEATING AND BENNETT, LLP

(57) ABSTRACT

A rigging equipment diagnostic device includes a processor and a storage to store a program to be executed by the processor. The processor executes an equipment information collection process in which information on equipment fitted to a hull is collected, an attribute information acquisition process in which an attribute database to store attribute information including information on functions to be realized is searched and attribute information on equipment fitted to the hull is acquired, a requirement information acquisition process in which requirement information is acquired by searching a requirement database that stores requirement information necessary to realize functions corresponding to respective attribute information, a function determination process in which a realizable function and an unrealizable function are determined by comparing equipment information and requirement information, and a function information provision process in which the determination result is provided.

13 Claims, 5 Drawing Sheets

FIG. 2

91

| Large classification | Small classification | Model name | SWVer | Attribute | Essential | Attribute | Essential | Attribute | Essential | Attribute | Essential | Attribute | Essential |
|---|---|---|---|---|---|---|---|---|---|---|---|---|---|
| Outboard motor | Outboard motor ECU-A | | | | | | | | | | | | |
| | Outboard motor ECU-B | | | Function A/A1.0 | Y | | | | | | | | |
| | Outboard motor ECU-C | | | Function A/A1.0 | Y | Function B/A1.0 | Y | | | | | | |
| Display equipment | Display equipment-A | ABC-00 | 5.00 | Function A/A1.0 | | | | | | | | | |
| | | ABC-** | 5.50 | Function A/A1.0 | | Function B/A1.0 | | | | | | | |
| | | ABC-** | 7.00 | Function A/A1.0 | | Function B/A1.0 | | Function C/A1.0 | | Function D/A1.0 | | Function F/A1.0 | |
| Information converter | Information converter-A | GHI-00 | GHI-00 | | | | | | | | | | |
| Input equipment I | Input equipment I-A | JKL-** | JKL-10 | Function A/A1.0 | Y | | | | | | | | |
| | | JKL-** | JKL-11 | Function A/A1.0 | Y | Function B/A1.0 | | | | | | | |
| | | NOP-00 | NOP-00 | Function A/A1.0 | Y | Function B/A2.0 | | Function C/A1.0 | | Function D/A1.0 | | Function E/A1.0 | Y |
| Input equipment II | Input equipment I-A | NOP-00 | NOP-00 | Function D/A1.0 | Y | | | | | | | | |
| Output equipment | Output equipment A | QRS-00 | QRS-00 | Function B/A1.0 | Y | | | | | | | | |
| | | QRS-01 | QRS-01 | Function B/A2.0 | Y | | | | | | | | |
| Control equipment I | Control equipment I-A | NOP-00 | NOP-00 | Function C/A1.0 | Y | Function D/A1.0 | | | | | | | |
| | Control equipment I-B | NOP-00 | NOP-00 | Function C/A1.0 | Y | | | | | | | | |
| | Control equipment I-C | NOP-00 | NOP-00 | Function C/A1.0 | Y | | | | | | | | |
| | Control equipment I-D | NOP-00 | NOP-00 | Function C/A1.0 | Y | | | | | | | | |
| Control equipment II | Control equipment II-A | NOP-00 | NOP-00 | Function F/A1.0 | Y | | | | | | | | |
| Control equipment III | Control equipment III-A | NOP-00 | NOP-00 | Function E/A1.0 | | | | | | | | | |

FIG. 3

92

| Classification | Specifications | Ver | Prerequisite/Ver | Required equipment/lower limit version |
|---|---|---|---|---|
| Function A | A | 1.0 | | Outboard motor/function A1.0, input equipment I/function A1.0 |
| | | | | |
| Function B | A | 1.0 | Function A/A1.0 | Input equipment I/function B1.0, display equipment/function B1.0, output equipment/function B1.0 |
| | A | 2.0 | Function A/A1.0 | Input equipment I/function B2.0, display equipment/function B2.0, output equipment/function B2.0 |
| | | | | |
| Function C | A | 1.0 | Function B/A1.0 | Input equipment I/function C1.0, display equipment/function C1.0, control equipment I-A/function C1.0, Control equipment I-B/function C1.0, control equipment I-C/function C1.0, control equipment I-D/function C1.0 |
| | | | | |
| Function D | A | 1.0 | Function C/A1.0 | Input equipment I/function D1.0, input equipment II/function D1.0, display equipment/function D1.0, control equipment I-A/function D1.0 |
| | | | | |
| Function E | A | 1.0 | | Input equipment I/function E1.0, control equipment III/function E1.0 |
| | | | | |
| Function F | A | 1.0 | | Control equipment II/function F1.0, display equipment/function F1.0 |
| | | | | |

FIG. 4

93

| Classification | Number | Priority | Outline | Applied conditions | Compatibility determination conditions | Measure |
|---|---|---|---|---|---|---|
| Outboard motor | | | | | | |
| | | | | | | |
| Display equipment | SA001 | Essential | All of display equipment of the same type within the system have the same attribute Ver. | Number of detected display equipment ≧ 2<br>Types of display equipment match each other. | Attributes and attribute Ver of respective display equipment match each other | Warning display |
| | SA002 | Recommended | All of display equipment of the same type within the system have the same SW Ver. | Number of detected display equipment ≧ 2<br>Types of display equipment match each other. | SW Ver of respective display equipment match each other | Recommendation display |
| | SA003 | Essential | The total number of input equipment I detected within the system is larger than the total number of display equipment. | Detect input equipment I | Number of input equipment I > display equipment | Warning display |
| | | | | | | |
| Input equipment I | SB001 | Essential | All of input equipment I are used with the same SW Ver. | Number of detected input equipment I ≧ 2 | SW Ver of respective input equipment I match each other | Warning display |
| | | | | | | |
| Output equipment | SC001 | Essential | All of output equipment within the system are used with the same attribute Ver. | Number of detected output equipment ≧ 2 | Attribute Ver of respective input equipment I match each other | Warning display |
| | | | | | | |
| Exception | SX001 | Essential | Only when * or more ** are detected, the attribute Ver of classification equipment is * or higher. | Number of detected ** ≧ * | Attribute Ver of ** ≧ * | Warning display |

RIGGING EQUIPMENT DIAGNOSTIC DEVICE

CROSS REFERENCE TO RELATED APPLICATIONS

This application claims the benefit of priority to Japanese Patent Application No. 2019-086293 filed on Apr. 26, 2019. The entire contents of this application are hereby incorporated herein by reference.

BACKGROUND OF THE INVENTION

1. Field of the Invention

The present invention relates to a rigging equipment diagnostic device to provide diagnostic information on equipment fitted to a hull.

2. Description of the Related Art

A pleasure boat such as an outboard motor boat includes a hull and various equipment fitted to the hull (outfitting or rigging equipment). A boat builder or dealer selects and combines a hull and rigging equipment according to customers' demands, and fits the equipment to the hull and assembles a vessel. As a result, vessels having various arrangements customized according to customers' demands are provided. For example, refer to US patent application publication No. 2010/0305789 A1.

SUMMARY OF THE INVENTION

The inventor of preferred embodiments of the present invention described and claimed in the present application conducted an extensive study and research regarding a rigging equipment diagnostic device, and in doing so, discovered and first recognized new unique challenges and previously unrecognized possibilities for improvements as described in greater detail below.

Rigging equipment cannot be combined without restrictions, and a proper combination of rigging equipment must be selected under certain restrictions. For example, when new-generation rigging equipment and old-generation rigging equipment having different production years are combined, compatibility between these must be established. For controllers such as an engine ECU (Electronic Control Unit) and a remote control ECU, software rewriting (version upgrading) for the purpose of improvement in function is possible in some cases. Therefore, it is also necessary to consider compatibility between software versions of the controllers and other rigging equipment. For example, there may be a case in which a function that should be provided by the latest version software is not realized by a combination with old-generation rigging equipment, and does not meet the customer's demands.

Therefore, at the time of assembly and purchase of a vessel and retrofitting of rigging equipment, a boat builder, dealer, or user needs to check compatibilities among a plurality of rigging equipment, and the burden of this checking is great. In other words, without an accumulation of sufficient knowledge of the compatibilities, proper rigging equipment cannot be selected quickly. Moreover, a software version cannot be known from an external appearance of equipment, so that it is a difficult matter to instantly judge whether a desired function is realized by a combination with other rigging equipment.

Preferred embodiments of the present invention provide rigging equipment diagnostic devices each capable of providing information on the ability to realize functions by automatically extracting information on equipment fitted to a hull.

A preferred embodiment of the present invention provides a rigging equipment diagnostic device including a processor and a storage to store a program to be executed by the processor. Upon executing the program, the processor executes an equipment information collection process in which information on equipment fitted to a hull is collected; an attribute information acquisition process to search an attribute database that stores, with respect to various equipment that is able to be fitted to a hull, attribute information including information on functions to be realized by single equipment or a combination of a plurality of equipment based on information collected by the equipment information collection process, and acquire attribute information of equipment fitted to the hull; a requirement information acquisition process to search a requirement database that stores, with respect to various attribute information, requirement information necessary to realize functions corresponding to respective attribute information based on attribute information acquired by the attribute information acquisition process, and acquire requirement information of the corresponding attribute information; a function determination process in which a realizable function and an unrealizable function are determined by comparing equipment information collected by the equipment information collection process and requirement information acquired by the requirement information acquisition process; and a function information provision process in which information showing the determination result obtained by the function determination process is provided by controlling a notifier.

With the rigging equipment diagnostic device described above, information on equipment fitted to a hull is collected, and based on the information, the attribute database is searched. Accordingly, attribute information of the equipment fitted to the hull is acquired. By searching the requirement database based on the attribute information, requirement information of the corresponding attribute information is acquired. By comparing the requirement information and the information on the equipment fitted to the hull, a realizable function and an unrealizable function are determined. Information showing the determination result is provided. In this way, by automatically extracting information on rigging equipment, information showing the ability to realize corresponding functions is provided.

A user of the diagnostic device may be, typically, a service person of a boat builder or dealer.

In a preferred embodiment of the present invention, in the function information provision process, information on functions realizable by current equipment fitted to the hull are provided based on the determination result of the function determination process. With this capability, a user of the diagnostic device is able to easily know functions realizable by using equipment fitted to the hull.

In a preferred embodiment of the present invention, in the function information provision process, based on the determination result of the function determination process, information on a function that is able to be realized by equipping an additional requirement in the hull, and information on the requirement that should be added in order to realize the function, are provided. With this capability, a user of the diagnostic device is able to easily know a function that is able to be realized by the addition of a requirement, and is able to easily know the requirement that should be added.

The requirement that should be added may be the addition of rigging equipment, replacement of rigging equipment, updating of a software version of rigging equipment, etc.

In a preferred embodiment of the present invention, in the function information provision process, based on the determination result of the function determination process, information on a function that is able to be realized by adding equipment to the hull, and information on the equipment that should be added, are provided. With this capability, a user of the diagnostic device is able to easily obtain information on a function that is able to be realized by additional fitting of equipment and the equipment to be added, so that the user is able to easily take a measure to realize the function.

In a preferred embodiment of the present invention, in the function information provision process, based on the determination result of the function determination process, information on a function that is able to be realized by changing a software version of equipment fitted to the hull, and information on the software, are provided. With this capability, a user of the diagnostic device is able to easily obtain information on a function that is able to be realized by changing a software version of equipment and the software, so that the user is able to easily take a measure to realize the function.

In a preferred embodiment of the present invention, the rigging equipment diagnostic device further includes an input that accepts an input of attribute information, and in the requirement information acquisition process, the requirement database is searched based on attribute information accepted by the input, and requirement information of the corresponding attribute information is further acquired, and in the function determination process, attribute information accepted by the input and requirement information acquired by the requirement information acquisition process are further compared, and a realizable function and an unrealizable function are determined.

With this capability, with respect to attribute information other than attribute information of equipment fitted to the hull, requirement information is acquired, whether a function corresponding to the attribute information is realizable is determined, and the determination result is provided. Accordingly, whether a desired function is realizable is able to be easily known.

In this case, it is more preferable that in the function information provision process, based on the determination result of the function determination process, information on a function that is able to be realized by equipping an additional requirement in the hull, and information on the requirement that should be added in order to realize the function, are provided. Accordingly, concerning a desired function, a user of the diagnostic device is able to easily know a function that is able to be realized by addition of a requirement, and is able to easily know the requirement that should be added.

In a preferred embodiment of the present invention, the processor, upon executing the program, further executes an operating condition acquisition process to search an operating condition database that stores, with respect to various equipment that is able to be fitted to the hull, operating conditions that provide normal operations, based on information collected by the equipment information collection process, and operating conditions with respect to equipment fitted to the hull are acquired; an equipment operation determination process in which equipment information collected by the equipment information collection process and operating conditions acquired by the operating condition acquisition process are compared, and whether each equipment normally operates is determined; and an operation information provision process in which information showing the determination result obtained by equipment operation determination process is provided by controlling a notifier.

With this capability, information on equipment fitted to the hull is automatically collected, and based on the collected information, information showing whether each equipment normally operates is provided. Therefore, a user of the diagnostic device is able to easily know whether equipment fitted to the hull normally operates.

In a preferred embodiment of the present invention, in the operation information provision process, information on an operating condition that is not satisfied is provided based on the determination result of equipment operation determination process. With this capability, information on an operating condition that is not satisfied is provided, so that based on this information, a necessary measure is able to be quickly taken.

The above and other elements, features, steps, characteristics and advantages of the present invention will become more apparent from the following detailed description of the preferred embodiments with reference to the attached drawings.

BRIEF DESCRIPTION OF THE DRAWINGS

FIG. 2 shows an example of an attribute database.

FIG. 3 shows a detailed example of a requirement database.

FIG. 4 shows a detailed example of an operating condition database.

DETAILED DESCRIPTION OF THE PREFERRED EMBODIMENTS

Figure 1:
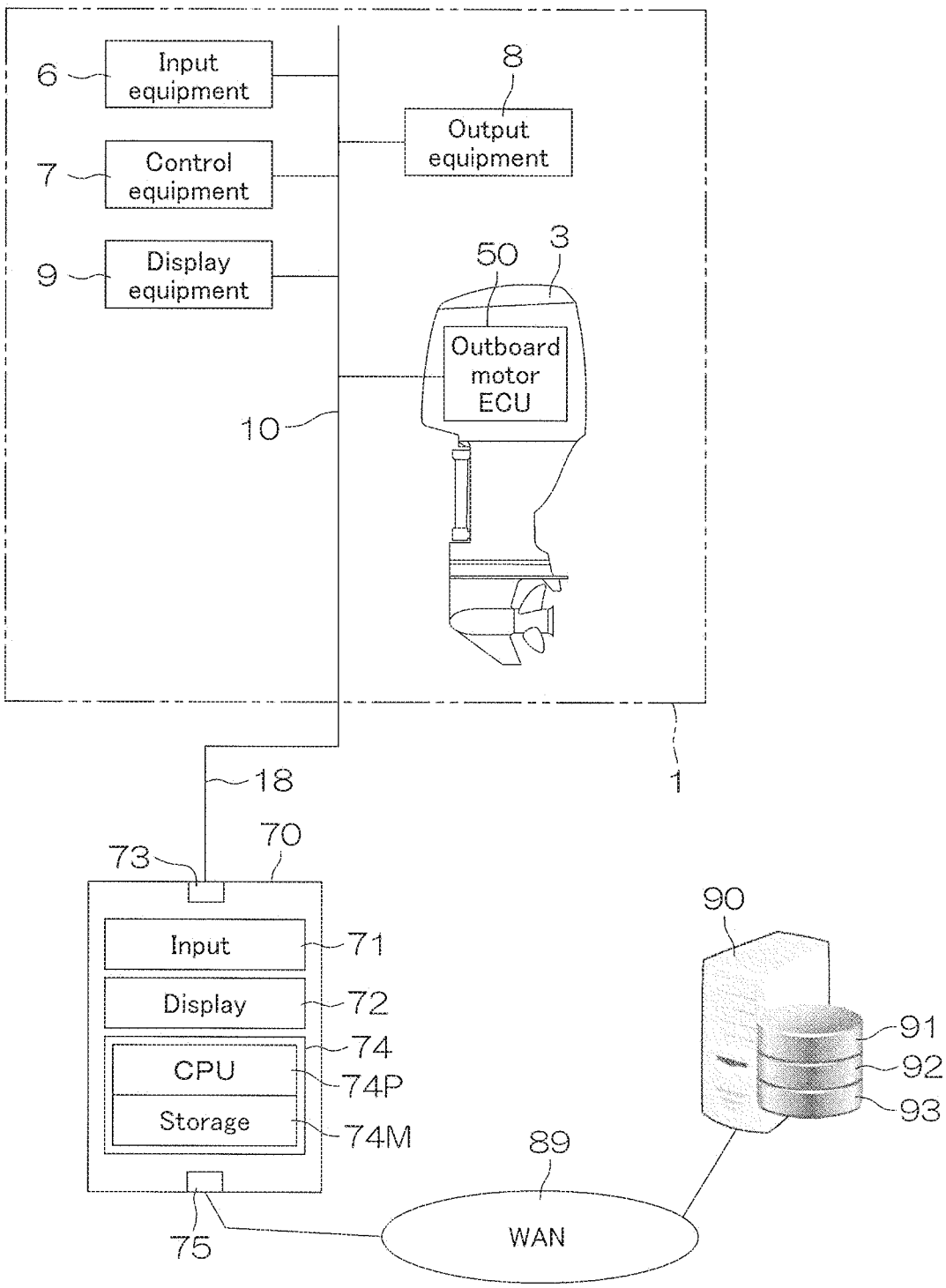
FIG. 1 is a block diagram to describe an example of a vessel and an example of a diagnostic device to which a preferred embodiment of the present invention is applied.

FIG. 1 is a block diagram to describe an example of a vessel, and an example of a diagnostic device to diagnose the vessel, to which a preferred embodiment of the present invention is applied. A vessel 1 is equipped with an outboard motor 3 as a propulsion apparatus. A plurality of outboard motors 3 may be equipped. Inside a hull of the vessel 1, an on-board LAN (Local Area Network) 10 as an example of the on-board network is provided. More specifically, to the on-board LAN 10, an input 6 to operate the vessel, control equipment 7 to control equipment fitted to the vessel 1, an outboard motor ECU 50 equipped in the outboard motor 3, and output equipment 8 and display equipment 9 for adjustments of a direction, etc., of a thrust of the outboard motor 3, are connected. These elements are able to communicate data and control signals with each other through the on-board LAN 10. Rigging equipment equipped in the vessel 1 may be connected with a wire or wirelessly to the on-board LAN 10.

The input equipment 6 is equipment to be operated by an operator to operate the vessel. An example of the input equipment is a steering wheel to be operated to adjust a direction of a thrust. Another example of the input equipment 6 is a remote control lever to be operated to adjust shifting and an output of the outboard motor 3. Still another example of the input equipment 6 is a joystick to be operated to adjust both of a traveling direction and an output.

An example of the output equipment 8 is a turning mechanism to turn the outboard motor 3 with respect to the hull. The turning mechanism includes, for example, an electric actuator that provides a turning force to the outboard motor 3.

An example of the control equipment 7 is a controller to perform controls related to navigation of the vessel 1. For example, the controller controls the output equipment 8 and the outboard motor 3 according to an operation of the input equipment 6 or, according to the circumstances, by overriding an operation of the input equipment 6. By such an operation of the controller, a so-called steer-by-wire (SBW) function, a drive-by-wire (DBW) function, a joystick function, and an autopilot function, etc., are realized. Another example of the control equipment 7 is a controller to perform a control related to an antitheft function of the vessel 1. For example, the controller may perform a remote key function to lock/unlock the vessel 1 by communicating with a wireless type remote control key.

A diagnostic device 70 is able to be connected to the on-board LAN 10. The diagnostic device 70 may include, for example, a personal computer, and may include an input 71, a display 72, a communication port 73, and a processing device 74. The input 71 may include a keyboard and/or a pointer. The display 72 may be a two-dimensional display such as a liquid crystal display. The communication port 73 may be a LAN port connectable to the on-board LAN 10 through a LAN cable 18, and is an example of a communicator. The communication port 73 may be connectable to the on-board LAN 10 through an appropriate adapter if necessary, or may be connectable to the on-board LAN 10 wirelessly without using the LAN cable 18. The processing device 74 executes processes to communicate with the outside through the communication port 73, and various arithmetic processes.

The control equipment 7 and the outboard motor ECU 50 of the outboard motor 3 communicate with each other through the above-described on-board LAN 10 provided in the vessel 1.

The control equipment 7 designates an outboard motor ECU 50 as a communication destination and outputs a control command to the designated outboard motor ECU. The designated outboard motor ECU 50 receives this control command, and according to this control command, controls actuators equipped in the outboard motor 3.

The control equipment 7 acquires operation information from the input equipment 6 through the on-board LAN 10, and generates a control command corresponding to the operation information or overriding the operation information. The control equipment 7 transmits the generated control command to the outboard motor ECU 50 through the on-board LAN 10.

The processing device 74 of the diagnostic device 70 includes a processor 74P (CPU) and a storage 74M, and the processor 74P executes processes to communicate with the outside through the communication port 73, and various arithmetic processes according to programs stored in the storage 74M.

By communicating with equipment (rigging equipment) connected to the on-board LAN 10, the diagnostic device 70 is able to acquire information from each equipment. In addition, the diagnostic device 70 is connected to a wide area network (WAN) 89 such as the internet through the communication port 75. A server 90 that provides information for equipment diagnosis is included on the WAN 89. Typically, the server 90 is prepared by a manufacturer of equipment to be fitted to the vessel and located on the WAN 89.

The server 90 includes an attribute database 91, a requirement database 92, and an operating condition database 93. These databases may be distributed and located in two or more servers. By accessing the attribute database 91, the requirement database 92, and the operating condition database 93 through the WAN 89, the diagnostic device 70 is able to acquire necessary information from these databases. Detailed examples of the respective databases are described below.

FIG. 2 shows an example of the attribute database 91. The attribute database stores attribute information, etc., of equipment that is able to be fitted to the vessel. The attribute database is prepared by, for example, a manufacturer of the equipment. In this case, typically, information on all equipment provided by the manufacturer is stored in the attribute database.

The attribute database includes records of a plurality of kinds of equipment classified based on large classifications of the equipment, small classifications of the equipment, and model names. Specific examples of the large classifications include an outboard motor, display equipment, an information converter, input equipment I (for example, a remote control lever), input equipment II (for example, a joystick), output equipment, control equipment I (for example, a controller to control navigation of the vessel), control equipment II (for example, a controller to manage a battery), and control equipment III (for example, a controller for the remote key function), etc. Specific examples of the small classifications include, for example, information concerning outboard motors, and types (ECU-A, ECU-B, ECU-C) of outboard motor ECUs. For example, the ECU-A may be an ECU of a type that does not support either of the SBW function and the DBW function. The ECU-B may be an ECU of a type non-compliant to the SBW function but compliant to the DBW function. The ECU-C may be an ECU of a type that supports both the SBW function and the DBW function.

With respect to the plurality of kinds of equipment, the attribute database contains records of individual models. A record of each model includes a model name, a software version (SW Ver), and attribute information. When a plurality of software versions are present for one model, the number of records of this model corresponds to the number of software versions. In other words, when a version of software of a certain model is upgraded, a record corresponding to this software version is added. Each record includes one or more attribute information.

Attribute information includes information showing a function that is realized by one or a plurality of equipment. Specific examples of the function include the DBW function, the SBW function, the autopilot function, the joystick function, and the remote key function, etc. Attribute information includes a function name, specification information, and version information (Ver). The specification information is information showing compatibility. Attribute information sharing specification information is compatible with each other. In other words, equipment that is fitted to one vessel and defines one system needs to have common specification information. Version information is information showing a version of the function.

For example, specification information is represented by an alphabet to be updated in order like A, B, C . . . according to specification changes. Version information has, for example, an integer portion and a decimal portion, and is updated so as to change the integer portion in a case of version revision for upward compatibility, and change the decimal portion in a case of version revision for responding to a failure.

To each attribute information, additional information "essential" is added which represents whether the attribute is essential or arbitrary in the model and the software version of the record. Attribute information accompanied with the additional information "Y" representing essentiality shows, in the model and software version of the record, an attribute (function) essential for the operation of the model and software version. Attribute information not accompanied with additional information showing essentiality shows an attribute (function) that is not essential for the operation but is enabled by a combination with other proper equipment in the model and software version of the record.

For example, in an outboard motor including an outboard motor ECU-C, a function A (for example, the DBW function) of version 1.0 with specifications A and a function B (for example, the SBW function) of version 1.0 with specifications A are essential, and if the outboard motor does not have these functions (attributes), this outboard motor cannot be operated. Concerning input equipment I-A (for example, the remote control lever) of a model name "JKL-**," when its software version is "JKL-11," it is essential that the input equipment is used with the function A of version 1.0 with specifications A. On the other hand, it is not essential that this input equipment I-A is used together with the function B, and copes with as necessary to the function B of version 1.0 with specifications A. It is essential that input equipment I-A of a model name "NOP-00" is used together with the function A of version 1.0 with specifications A and a function E (for example, the remote key function) of version 1.0 with specifications A; however, it is not essential that this input equipment is used together with the function B. This input equipment I-A copes with as necessary to the function B of version 2.0 with specifications A. Further, this input equipment I-A copes with as necessary to a function C (for example, the autopilot function) of version 1.0 with specifications A, and a function D (for example, the joystick function) of version 1.0 with specifications A.

FIG. 3 shows a detailed example of the requirement database 92. The requirement database contains records of a plurality of attribute information. Each of the records includes classification information, specification information, version information (Ver), prerequisite subsystem/version information (Ver), and required equipment/lower limit version information. Classification information is information showing the kind of an attribute (function). Specification information and version information are as described above. Prerequisite subsystem/version information includes subsystem and version information (including specification information) of the subsystem which are prerequisites to realize the attribute (function). Required equipment/lower limit version information shows equipment essential to realize the attribute (function) and lower limit version information (including specification information) of the essential equipment.

For example, to realize the function B of version 2.0 with specifications A, a subsystem for the function A of version 1.0 with specifications A needs to be equipped as a prerequisite. In addition, the input equipment I corresponding to the function B of version 2.0, display equipment corresponding to the function B of version 2.0, and output equipment corresponding to the function B of version 2.0 are required.

FIG. 4 shows a detailed example of the operating condition database 93. The operating condition database contains records of a plurality of operating conditions. Each of the records includes classification information, a condition number, priority information, outline information, application conditions, compatibility determination conditions, and a measure, etc. Classification information is information showing a function to be equipped, and a detailed example of the classification information is an outboard motor, display equipment, input equipment I, and output equipment, etc. A condition number is a number of an operating condition. Specific examples of priority information are essential conditions and recommended conditions, etc.

Essential conditions are operating conditions essential when a function represented by classification information is equipped. Recommended conditions are operating conditions that are not essential but recommended when a function represented by the classification information is equipped. Outline information is information showing detailed content of operating conditions. In the example shown in FIG. 4, in classification of display equipment, essential conditions are conditions that display equipment of the same model within the system are used with the same attribute version, and display equipment the number of which is not less than the total number of the input equipment I are equipped. Use of display equipment of the same model with the same software version is recommended, but is not essential.

Application conditions are conditions for application of the operating conditions. Compatibility determination conditions include information showing detailed determination matters. For example, application conditions of operating conditions that all of display equipment of the same model within the system are used with the same attribute version are conditions that two or more display equipment are equipped in the system, and are of the same model. Then, when these application conditions are satisfied, as compatibility determination conditions, whether attributes of the respective display equipment match each other and whether the attribute versions of these display equipment match each other are determined, and accordingly, whether the operating conditions are satisfied or not is determined.

The measure is instruction information concerning a countermeasure to be taken when an operating condition is not satisfied. In the example shown in FIG. 4, a "measure" to be taken when an essential condition is not satisfied is a warning display, and a measure to be taken when a recommended condition is not satisfied is a "recommendation display."

Figure 5:
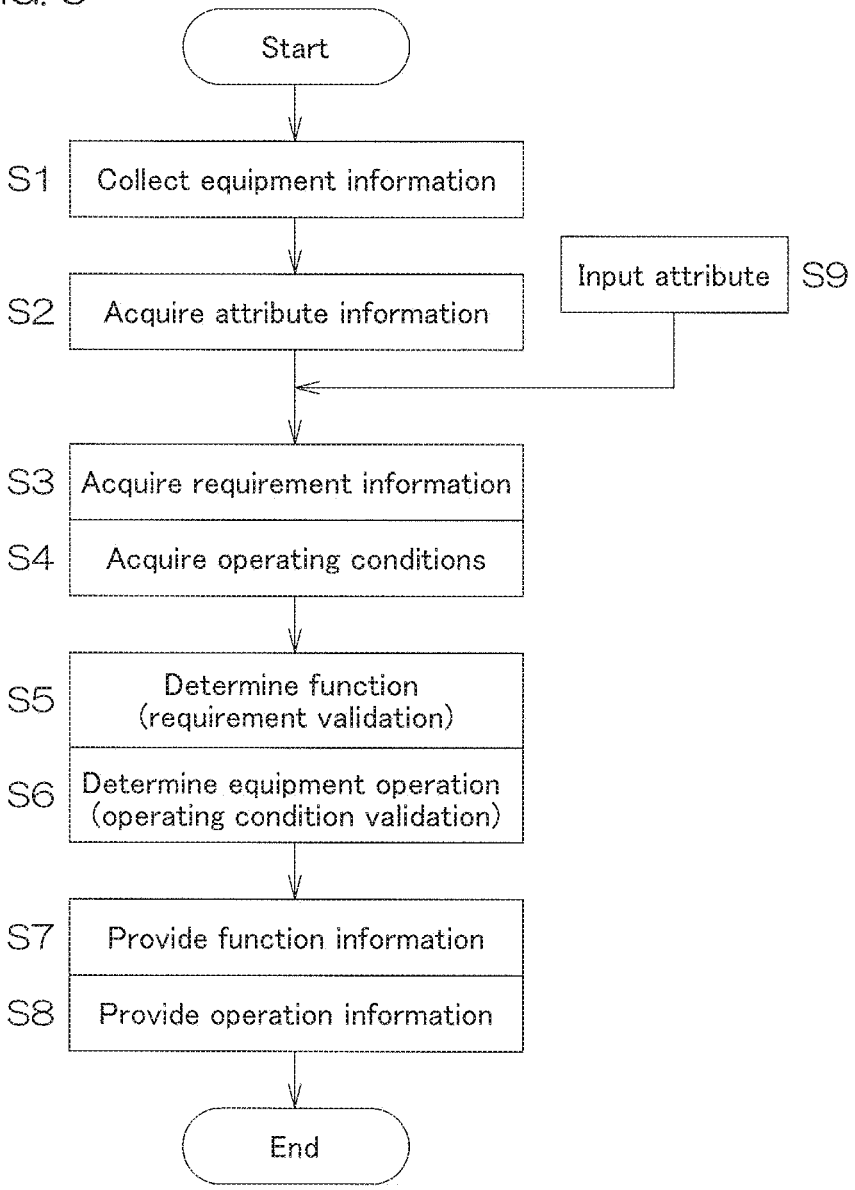
FIG. 5 is a flowchart showing an example of processes to be executed by the diagnostic device.

FIG. 5 is a flowchart showing an example of a process to be executed by connecting the diagnostic device 70 to the on-board LAN 10 and the WAN 89. A user of the diagnostic device 70, that is, a diagnostic operator is typically a service person of a boat builder or dealer.

The operator makes the diagnostic device 70 execute an equipment information collection process in a state in which the diagnostic device 70 is connected to the on-board LAN 10 (Step S1). More specifically, the processor 74P of the diagnostic device 70 sends out an equipment information request to collect information on all equipment connected to the on-board LAN 10 to the on-board LAN 10 through the communication port 73. Then, all equipment connected to the on-board LAN 10 send out response information including information on the equipment to the on-board LAN 10 by setting the diagnostic device 70 as a sending destination. The processor 74P receives the sent out response information through the communication port 73, and stores the response information in the storage 74M. In this way, the diagnostic device 70 is able to collect information on all equipment connected to the on-board LAN 10.

A detailed example of equipment information to be collected is shown in Table 1. In this example, it can be seen that one display equipment, one input equipment I (for example, a remote control lever), one outboard motor, one output equipment, and one control equipment I (for example, a controller for navigation control) are connected to the on-board LAN 10. Information on each equipment includes information on the category, a model name, and a software version (SW Ver). These pieces of information are included in the response information from each equipment.

TABLE 1

| Category | Model name | SW Ver |
|---|---|---|
| Display equipment | ABC-00 | 5.00 |
| Input equipment I | NOP-00 | NOP-00 |
| Outboard motor | *** | *** |
| Output equipment | QRS-00 | QRS-00 |
| Control equipment I | NOP-00 | NOP-00 |

Next, the processor 74P executes an attribute information acquisition process by accessing the server 90 through the WAN 89 (Step S2). More specifically, the processor 74P searches the attribute database 91 based on collected equipment information, and extracts and acquires attribute information of the corresponding equipment. The processor 74P stores the acquired attribute information in the storage 74M. An example of the attribute information to be acquired is shown in Table 2. Those described in Table 2 are the same as in FIG. 2, so that descriptions of them are omitted.

TABLE 3

| Essential attribute | Prerequisite | Requirement |
|---|---|---|
| Function A/A1.0 | | Outboard motor/function A1.0<br>Input equipment I/function A1.0 |
| Function B/A1.0 | Function A/A1.0 | Input equipment I/function B1.0<br>Display equipment/function B1.0<br>Output equipment/function B1.0 |
| Function C/A1.0 | Function B/A1.0 | Input equipment I/function C1.0<br>Display equipment/function C1.0<br>Control equipment I-A/function C1.0<br>Control equipment I-B/function C1.0<br>Control equipment I-C/function C1.0<br>Control equipment I-D/function C1.0 |
| Function E/A1.0 | | Input equipment I/function E1.0<br>Control equipment III/function E1.0 |
| **Arbitrary attribute** | **Prerequisite** | **Requirement** |
| Function B/A2.0 | Function A/A1.0 | Input equipment I/function B2.0<br>Display equipment/function B2.0<br>Output equipment/function B2.0 |
| Function D/A1.0 | Function C/A1.0 | Input equipment I/function D1.0<br>Input equipment II/function D1.0<br>Display equipment/function D1.0<br>Control equipment I-A/function D1.0 |
| Operating conditions | | Not applicable |

In this example, essential attribute conditions, arbitrary attribute conditions, and operating conditions are extracted. The function A of version 1.0 with specifications A is one of the essential attributes, and requirements for this are an outboard motor and input equipment I that correspond to the function A of version 1.0. The function B of version 1.0 with specifications A is one of the essential attributes, and as a prerequisite for this, the function A of version 1.0 with specifications A is requested, and input equipment I, display equipment, and output equipment corresponding to the function B of version 1.0 are required. Other essential attributes are described similarly. Arbitrary attribute conditions are also described similarly. In the example shown in Table 3, no operating conditions are applicable.

TABLE 2

| Kind | Model name | SW Ver | Attribute | Essential | Attribute | Essential | Attribute | Essential | Attribute | Essential | Attribute | Essential |
|---|---|---|---|---|---|---|---|---|---|---|---|---|
| Display equipment | ABC-00 | 5.00 | Function A/A1.0 | | | | | | | | | |
| Input equipment I | NOP-00 | NOP-00 | Function A/A1.0 | Y | Function B/A2.0 | | Function C/A1.0 | | Function D/A1.0 | | Function E/A1.0 | Y |
| Outboard motor | *** | *** | Function A/A1.0 | Y | Function B/A1.0 | Y | | | | | | |
| Output equipment | QRS-00 | QRS-00 | Function B/A2.0 | Y | | | | | | | | |
| Control equipment I | NOP-00 | NOP-00 | Function C/A1.0 | Y | Function D/A1.0 | | | | | | | |

Further, the processor 74P accesses the server 90 through the WAN 90, and executes a requirement information acquisition process (Step S3) and an operating condition acquisition process (Step S4). More specifically, the processor 74P searches the requirement database 92 based on the acquired attribute information, and extracts information on equipment and a version necessary for each attribute. In addition, the processor 74P searches the operating condition database 93 based on the acquired attribute information, and extracts and acquires corresponding operating conditions. The processor 74P stores the information acquired from the requirement database 92 as requirement information in the storage 74M. Further, the processor 74P stores the information acquired from the operating condition database 93 as operating conditions in the storage 74M.

Examples of the requirement information and the operating conditions to be acquired are shown in Table 3. Those described in Table 2 are the same as in FIG. 3 and FIG. 4, and descriptions of them are omitted. The requirement information acquired in this way define an inspection pattern to inspect the system within the vessel 1.

In addition to the extracted requirement information, an operator is able to add an attribute (function) that the user needs by operating the input 71 of the diagnostic device 70 (Step S9). The processor 74P acquires requirement information and operating conditions by referring to the requirement database 92 and the operating condition database 93 according to an input attribute (Steps S3 and S4), and adds corresponding attribute conditions and operating conditions to the inspection pattern.

The processor 74P further executes a function determination process (requirement validation) to determine whether the information collected from the equipment (refer to Table 1) and the attribute information input from the input 71 correspond to requirement information (refer to Table 3) defining the inspection pattern (Step S5). In addition, the processor 74P executes an equipment operation determination process to determine whether the information collected from the equipment (refer to Table 1) and the attribute information input from the input 71 satisfy the operating conditions (refer to Table 3) defining the inspection pattern (Step S6).

An example of results of the function determination process and equipment operation determination process is shown in Table 4. In Table 4, an underlined item indicates that a requirement is not satisfied, and italic letters indicate that a corresponding product is undetected.

TABLE 4

| Result | Essential attribute | Pre-requisite | Requirement |
|---|---|---|---|
| OK | Function A/A1.0 | | Outboard motor/function A1.0<br>Input equipment I/function A1.0 |
| NG | Function B/A1.0 | Function A/A1.0 | Input equipment I/function B1.0<br>Display equipment/function B1.0<br>Output equipment/function B1.0 |
| NG | Function C/A1.0 | Function B/A1.0 | Input equipment I/function C1.0<br>Display equipment/function C1.0<br>Control equipment I-A/function C1.0<br>Control equipment I-B/function C1.0<br>Control equipment I-C/function C1.0<br>Control equipment I-D/function C1.0 |
| OK | Function E/A1.0 | | Input equipment I/function E1.0<br>Control equipment III/function E1.0 |
| **Result** | **Arbitrary attribute** | **Pre-requisite** | **Requirement** |
| NG | Function B/A2.0 | Function A/A1.0 | Input equipment I/function B2.0<br>Display equipment/function B2.0<br>Output equipment/function B2.0 |
| NG | Function D/A1.0 | Function C/A1.0 | Input equipment I/function D1.0<br>Input equipment II/function D1.0<br>Display equipment/function D1.0<br>Control equipment I-A/function D1.0 |
| Operating conditions | | | Not applicable |

With respect to "function A/A1.0" and "function E/A1.0" among the essential attributes, the requirements are satisfied, so that the determination result is "OK" showing satisfactory. On the other hand, with respect to "function B/A1.0" among the essential attributes, for the reason that the display equipment does not correspond to the function B of version 1.0, the determination result is "NG" showing not satisfactory. With respect to "function C/A1.0" among the essential attributes, for the reason that "function B/A1.0" as a prerequisite is not satisfied, the display equipment does not correspond to the function C of version 1.0, and further, "control equipment I-B/function C1.0, control equipment I-C/function C1.0, control equipment I-D/function C1.0" are not equipped, the determination result is "NG" showing not satisfactory. With respect to "function B/A2.0" of the arbitrary attributes, for the reason that the display equipment does not correspond to the function B of version 2.0, the determination result is "NG" showing unsatisfactory. With respect to "function D/A1.0" of the arbitrary attributes, for the reason that "function C/A1.0" as a prerequisite is not satisfied, the display equipment does not correspond to the function D of version 1.0, and further, "input equipment II/function D1.0" is not equipped, the determination result is "NG" showing not satisfactory. When there is an operating condition to be applied, it is also determined whether the operating condition is satisfied/not satisfied.

The processor 74P executes a function information provision process to provide the results of such determinations as to whether requirements are satisfied/not satisfied by displaying the results on the display 72 (Step S7). In addition, the processor 74P also executes an operation information provision process to provide whether operating conditions are satisfied/not satisfied by displaying the result on the display 72 in the same manner (Step S8). Thus, the display 72 is an example of the notifier to be controlled by the processing device 74. An example of the display is shown in Table 5.

TABLE 5

[Following functions are usable.]
Function A: requirements are satisfied.
Function E: requirements are satisfied.
[Warning]
Function B: requirements are not satisfied (SW version).
→ Update SW of display equipment to XXX.
Function C: requirements are not satisfied (essential devices are not detected). → Connect products in categories of control equipment I-B, control equipment I-C, and control equipment I-D.
[Caution/recommendation]
Function B: (requirements are partially satisfied) → Function B2.0 is not usable. Or function B2.0 will become usable by updating SW of display equipment.
Function D: (requirements are partially satisfied) → Function D will become usable by adding product corresponding to function D and updating SW of display equipment.
[Operating conditions]
Not applicable In this example, it is notified that the function A and the function E are usable. Indication of "Warning" is displayed when an essential attribute is not satisfied. In the example described above, the requirement of the function B is not satisfied, and as a detailed countermeasure, it is instructed to change the software version of the display equipment. In addition, the requirements of function C are not satisfied, and as a detailed countermeasure, it is instructed to connect products in categories of control equipment I-B, control equipment I-C, and control equipment I-D. Indication of "Caution/recommendation" is displayed when an arbitrary attribute is not satisfied. In the example described above, the requirement of the function B of version 2.0 is not satisfied, and it is instructed that this function will become usable by updating software of the display equipment. In addition, although the requirements for the function D are not satisfied, the prerequisite is satisfied, so that it is instructed that by adding a product corresponding to the function D and updating software of display equipment, this function will become usable.

Concerning operating conditions, "Not applicable" is displayed. When there is an operating condition to be applied and the operating condition is satisfied, satisfactory of the operating condition is displayed. When there is an operating condition to be applied and the operating condition is not satisfied, not satisfactory of the operating condition is displayed, and further, the operating condition that is not satisfied is displayed in detail.

As described above, according to a preferred embodiment of the present invention, the diagnostic device 70 collects information on equipment fitted to the hull through the on-board LAN 10, and based on the collected information, searches the attribute database 91. Accordingly, the diagnostic device 70 acquires attribute information of equipment fitted to the hull. Based on the attribute information, the diagnostic device 70 further searches the requirement database 92 and acquires requirement information of the attribute information. The diagnostic device 70 determines a realizable function and an unrealizable function by comparing the requirement information and information on the equipment fitted to the hull, and provides the determination result by the display 72. In this way, the diagnostic device 70 is able to automatically extract information on fitted equipment and provide the ability to realize information of various functions.

More specifically, in a preferred embodiment of the present invention, the diagnostic device 70 provides information on functions that are able to be realized by current equipment fitted to the hull. Accordingly, a user of the diagnostic device 70 is able to easily know functions that are able to be realized by using equipment fitted to the hull.

In addition, a preferred embodiment of the present invention, the diagnostic device 70 provides information on a function that is able to be realized by equipping an additional requirement in the hull, and information on the requirement that should be added in order to realize the function. Accordingly, a user of the diagnostic device 70 is able to easily know a function that is able to be realized by addition of a requirement, and is able to easily know the requirement that should be added.

In a preferred embodiment of the present invention, the diagnostic device 70 provides information on a function that is able to be realized by adding equipment fitted to the hull, and information on the equipment that should be added. Accordingly, a user of the diagnostic device 70 is able to easily know information on a function that is able to be realized by addition of equipment and the equipment to be added, so that the user is able to easily take a countermeasure to realize the function.

In a preferred embodiment of the present invention, the diagnostic device 70 provides information on a function that is able to be realized by changing a software version of equipment fitted to the hull, and information on this software. Accordingly, a user of the diagnostic device 70 is able to easily obtain information on a function that is able to be realized by changing a software version of the equipment and the software, so that the user is able to easily take a countermeasure to realize this function.

In a preferred embodiment of the present invention, attribute information corresponding to a desired function is able to be input into the diagnostic device 70. The diagnostic device 70 searches the requirement database 92 based on the input attribute information and acquires requirement information of the corresponding attribute information. Then, the diagnostic device 70 compares the input attribute information and the requirement information, and determines a realizable function and an unrealizable function. The diagnostic device 70 provides the determination result to a user by displaying this on the display 72. Accordingly, the user of the diagnostic device 70 is able to easily know whether a desired function is realizable. In particular, in a preferred embodiment of the present invention, the diagnostic device 70 provides information on a requirement that is not satisfied to the user by displaying this on the display 72, so that the user is able to easily know the requirements necessary to realize the desired function.

In a preferred embodiment of the present invention, the diagnostic device 70 searches the operating condition database 93 that stores operating conditions that provide normal operations with respect to various rigging equipment, and acquires operating conditions with respect to equipment fitted to the hull. Then, the diagnostic device 70 compares equipment information collected through the on-board LAN 10 and the operating conditions acquired from the operating condition database 93, and determines whether each equipment normally operates. The diagnostic device 70 provides the determination result to a user by displaying this on the display 72. Accordingly, information on equipment fitted to the hull is automatically collected, and based on the collected information, information showing whether each equipment normally operates is provided. Therefore, the user of the diagnostic device 70 is able to easily know whether equipment fitted to the hull normally operates.

In a preferred embodiment of the present invention, the diagnostic device provides information on an operating condition that is not satisfied to a user by displaying this on the display 72. Accordingly, the user is able to quickly take a necessary countermeasure.

Although preferred embodiments of the present invention have been described above, the present invention can also be carried out in other preferred embodiments. For example, in the preferred embodiments described above, the diagnostic device 70 displays information on usable functions, information on unusable functions, and information on recommended functions that will become usable by addition of requirements on the display 72. However, for example, the display of information on usable functions may be omitted, the display of unusable functions may be omitted, or the display of information on recommended functions may be omitted. Information may be provided to a user by a method in which the information is transmitted to another terminal device as well as by display on the display 72.

In addition, in the server 90 or other appropriate servers connected to the WAN 89, the latest versions of software of rigging equipment may be stored. In this case, the diagnostic device 70 may check latest versions of software of equipment fitted to the hull. When software of rigging equipment is not a latest version, the diagnostic device 70 may update the software of this equipment by downloading the latest version software.

While preferred embodiments of the present invention have been described above, it is to be understood that variations and modifications will be apparent to those skilled in the art without departing from the scope and spirit of the present invention. The scope of the present invention, therefore, is to be determined solely by the following claims.

What is claimed is:

1. A rigging equipment diagnostic device comprising:

a processor; and a storage to store a program to be executed by the processor; wherein the processor, upon executing the program, executes:

an equipment information collection process to collect information on equipment fitted to a hull;

an attribute information acquisition process to search an attribute database that stores, with respect to equipment that is able to be fitted to the hull, attribute information including information on functions to be realized by an equipment or a combination of a plurality of equipment based on information collected by the equipment information collection process, and acquire attribute information on the equipment fitted to the hull;

a requirement information acquisition process to search a requirement database that stores, with respect to attribute information, requirement information necessary to realize functions corresponding to respective attribute information based on attribute information acquired by the attribute information acquisition process, and acquire requirement information of the corresponding attribute information;

a function determination process to determine a realizable function and an unrealizable function by comparing equipment information collected by the equipment information collection process and requirement information acquired by the requirement information acquisition process to determine whether the collected equipment information satisfies the acquired requirement information or not; and a function information provision process to provide information showing a determination result obtained by the function determination process by controlling a notifier; wherein the requirement information includes information of an essential equipment and a lower limit version information of the essential equipment essential to realize the function; and the essential equipment includes at least one of a propulsion apparatus, an input equipment to operate a vessel, a control equipment to control equipment fitted to the hull, an output equipment for adjustment of a direction of the hull, or a display.

2. The rigging equipment diagnostic device according to claim 1, wherein the function information provision process provides information on functions realizable by current equipment fitted to the hull based on the determination result of the function determination process.

3. The rigging equipment diagnostic device according to claim 1, wherein the function information provision process provides, based on the determination result of the function determination process, information on a function that is able to be realized by equipping an additional requirement in the hull, and information on the requirement that should be added in order to realize the function; and the requirement that should be added includes at least one of an essential equipment not satisfied and a lower limit version not satisfied.

4. The rigging equipment diagnostic device according to claim 1, wherein the function information provision process provides, based on the determination result of the function determination process, information on a function that is able to be realized by adding equipment to the hull, and information on the equipment that should be added.

5. The rigging equipment diagnostic device according to claim 1, wherein the function information provision process provides, based on the determination result of the function determination process, information on a function that is able to be realized by changing a software version of equipment fitted to the hull, and information on the software.

6. The rigging equipment diagnostic device according to claim 1, further comprising:

an input that accepts an input of attribute information; wherein the requirement information acquisition process searches the requirement database based on attribute information accepted by the input, and further acquires requirement information of the corresponding attribute information; and the function determination process further compares attribute information accepted by the input and requirement information acquired by the requirement information acquisition process, and determines a realizable function and an unrealizable function.

7. The rigging equipment diagnostic device according to claim 1, wherein the processor, upon executing the program, executes:

an operating condition acquisition process to search an operating condition database that stores, with respect to equipment that is able be fitted to the hull, operating conditions that provide normal operations based on information collected by the equipment information collection process, and acquire operating conditions with respect to equipment fitted to the hull;

an equipment operation determination process to compare equipment information collected by the equipment information collection process and operating conditions acquired by the operating condition acquisition process, and determine whether each equipment normally operates; and an operation information provision process to provide information showing the determination result obtained by the equipment operation determination process by controlling a notifier.

8. The rigging equipment diagnostic device according to claim 7, wherein the operation information provision process provides information on an operating condition that is not satisfied based on the determination result of the equipment operation determination process.

9. The rigging equipment diagnostic device according to claim 1, wherein the equipment information includes a model name and a software version of the equipment.

10. The rigging equipment diagnostic device according to claim 1, wherein the information on a function included in the attribute information includes a function name of the function, specification information showing compatibility of the function, and version information of the function.

11. The rigging equipment diagnostic device according to claim 1, wherein the requirement information includes classification information of a function, specification information showing compatibility of the function, and version information of the function.

12. The rigging equipment diagnostic device according to claim 1, wherein the equipment information collection process includes sending out to a network in the hull an equipment information request to collect the information on all equipment connected to the network, and collecting response information sent out to the network by all the equipment connected to the network.

13. The rigging equipment diagnostic device according to claim 1, wherein the attribute information includes information on at least one of a drive-by-wire function, a steer-by-wire function, an autopilot function, a joystick function, or a remote key function.

* * * * *